US010870312B2

(12) United States Patent
Klapperstück et al.

(10) Patent No.: US 10,870,312 B2
(45) Date of Patent: Dec. 22, 2020

(54) DECORATIVE BUILDING BOARD AND METHOD FOR PRODUCING SUCH A BUILDING BOARD

(71) Applicant: KNAUF GIPS KG, Iphofen (DE)

(72) Inventors: Stephan Klapperstück, Erfurt (DE); Tobias Willing, Oberschönau (DE)

(73) Assignee: KNAUF GIPS KG, Iphofen (DE)

( * ) Notice: Subject to any disclaimer, the term of this patent is extended or adjusted under 35 U.S.C. 154(b) by 108 days.

(21) Appl. No.: 15/757,916

(22) PCT Filed: Sep. 9, 2016

(86) PCT No.: PCT/EP2016/001521
§ 371 (c)(1),
(2) Date: Mar. 6, 2018

(87) PCT Pub. No.: WO2017/041895
PCT Pub. Date: Mar. 16, 2017

(65) Prior Publication Data

US 2018/0339547 A1 Nov. 29, 2018

(30) Foreign Application Priority Data

Sep. 11, 2015 (DE) ..... 10 2015 011 664

(51) Int. Cl.
*B44C 5/04* (2006.01)
*E04C 2/04* (2006.01)
*E04C 2/00* (2006.01)

(52) U.S. Cl.
CPC ..... *B44C 5/04* (2013.01); *B44C 5/043* (2013.01); *B44C 5/0438* (2013.01); *E04C 2/043* (2013.01); *E04C 2/044* (2013.01); *E04C 2002/005* (2013.01)

(58) Field of Classification Search
CPC ..... B44C 5/04; B44C 5/043; B44C 5/0438; B44C 5/0446; E04C 2002/005; E04C 2/043; B33C 1/1712; C04B 41/522; C04B 41/52; C04B 41/0045; C04B 41/009; C04B 41/0072; C04B 28/02; C04B 2111/0062; C04B 28/14; E04F 13/0871; C08K 7/10; Y10T 428/239; Y10T 428/23; Y10T 156/1043; B32B 2419/00; B32B 2260/044; B32B 13/04; B28B 11/0845
USPC ..... 427/385.5, 386, 407.1, 493, 496, 500, 427/508, 553, 558, 559; 428/141, 195.1, 428/68, 76; 542/2; 425/101
See application file for complete search history.

(56) References Cited

U.S. PATENT DOCUMENTS 3,738,854 A * 6/1973 Oishi ..... B44F 9/02 427/262
6,284,327 B1 9/2001 Neumann et al.

FOREIGN PATENT DOCUMENTS

DE 202006004493 U1 6/2006
DE 102010060441 A1 5/2012
WO 2014/147171 A1 9/2014

OTHER PUBLICATIONS

International Search Report and Written Opinion in International Patent Application No. PCT/EP2016/001521, dated Sep. 1, 2017.

* cited by examiner

*Primary Examiner* — Camie S Thompson
(74) *Attorney, Agent, or Firm* — Venable LLP; Keith G. Haddaway

(57) ABSTRACT

The invention relates to a method for the automated decoration of a building board, comprising at least one smoothing compound layer and preferably at least one colour coat. The method comprises the steps of smoothing and decorating the building board, wherein the smoothing includes the steps of (i) calibrating the building board to a nominal thickness, so that a surface of the building board has a height difference of at most 1 mm, (ii) applying a layer of a smoothing compound, (iii) pressing the smoothing compound into the surface structures of the building board, and (iv) recalibrating to the nominal thickness. Preferably, a plurality of smoothing compound layers are pressed into a calibrated surface of the building board and partially ground away again. The method is particularly well suited for the production of fire-resisting building boards.

17 Claims, No Drawings

DECORATIVE BUILDING BOARD AND METHOD FOR PRODUCING SUCH A BUILDING BOARD

The invention relates to a method for producing a decorative building board, as well as a decorative building board, in particular produced with this method. In particular, the invention relates to a method for the automated production of such building boards.

Decorative building boards are known from the prior art. They can find application in the most diverse fields: in drywall construction as a wall cladding, in the production of partition walls or ceilings. Floor coverings, for example also in the form of cavity or double floors, can be produced from building boards. However, it can also involve structural parts of furniture such as cabinets, shelves, tables etc. Building boards made of all possible materials are known, such as for example plasterboards, cement boards, wood-based building boards and also those which are produced from composite materials.

The decoration of the building boards can be carried out using the most diverse methods. The decoration can for example be applied or printed on a backing material, e.g. a paper web or liner, which is then laminated onto the building boards. This method has the drawback that two different workpieces, i.e. the building board and the printed paper web, are produced separately, which then have to the brought together for the production of the decorative building board. Moreover, the paper web has the drawback of being a further component of the decorative building board that is readily combustible. The production of fire-resisting decorative building boards is virtually impossible with this method.

According to another method known from the prior art, the surface of the building boards is levelled with a lacquer layer, which is then optionally printed and covered with a protective layer. The thickness of the first lacquer layer required for the levelling has to be relatively great in order to a level out all the unevennesses or defects and to make available an attractive surface quality of the decorative building board. This fact is not problematic as long as the building board is not used in areas in which fire resistance is required. On account of the comparatively large quantity of lacquer that is required for the levelling of the surface, a fire-resisting decorative building board with a qualitatively high-grade surface cannot be produced, even with the appropriate qualification of the building board as such.

An automated method for decorating building boards, wherein the decorative building boards can meet the requirements of fire resistance class A2 (DIN EN 13501-1, not combustible with contents of combustible building materials), is at present not known, because a control of the quantity of applied combustible coating materials has not so far been guaranteed. This is due in particular to the typically irregular surfaces of the building boards, which leads to non-uniform layer thicknesses of the coating materials, so that the layer thicknesses and therefore the overall calorific value from building board to building board varies considerably. Moreover, the application of the coating materials in an extremely small quantity with an optically appealing and adequate surface quality, especially in an automated manner, has not hitherto been possible.

The problem of the invention therefore consists in making available a further method for the automated decoration of a building board, wherein the method is intended also to be suitable for producing decorative building boards which at least meet the requirements of a fire resistance class B1 according to DIN EN 13501-1. The decorative building boards thus produced, with an appropriate selection of the building board material, should preferably even be able to meet the requirements of a fire-resisting board A2. Moreover, a decorative building board is to be made available, which with its decoration at least meets the requirements of a fire resistance class B1 according to DIN EN 13501-1.

The problem is solved by a method and a building board according to the independent claims.

A building board decorated according to the invention accordingly comprises at least one building board with a coating of a surface of the building board. The coating comprises at least one smoothing compound layer and at least one colour coat. The decorative building board preferably meets the requirements of a fire resistance class B1 (hardly flammable) according to DIN EN 13501-1. A building board decorated according to the invention particularly preferably at least meets the requirements of fire resistance class A2, in particular preferably even fire-resisting board A2-s1, d0. This means that, in the event of a fire, the building board exhibits no smoke generation or at all events scarcely any smoke generation (s1) and also no dripping or falling-off of components (d0).

The term "building board" is understood within the scope of this invention to mean building boards which are used in drywall construction, but also building boards which are used for the panelling of furniture. The building board can for example be intended for the panelling of walls, ceilings, doors and/or floors. It can however also relate to boards for the production of furniture, in particular tables, cupboards, shelves etc. or items of furniture in the broader sense.

According to a preferred embodiment of the invention, the building board is a gypsum-bound building board, in particular a plasterboard or a gypsum fibreboard. If the decorative building board does not need to exhibit any particular fire resistance, cement-bound fibreboards, mineral fibreboards, or chipboards or wooden composite boards, preferably raw particleboards or MDF or HDF boards can however also be used as a building board within the meaning of the invention. Other building boards that can be decorated using the method according to the invention are not intended to be excluded from the invention by this listing.

With an automated method according to the invention for decorating a building board, wherein the building board comprises at least one smoothing compound layer and at least one colour coat, such a decorative building board can be produced. The method comprises at least the steps of smoothing and preferably decorating the building board, wherein the smoothing of the building board includes at least the following steps:

- calibrating the building board to a nominal thickness, so that the surface of the building board has a height difference over an entire area of the surface of the building board of at most 1 mm, preferably at most 0.45 mm, and especially preferably at most 0.30 mm
- applying a first layer of a smoothing compound on the surface of the building board
- pressing the smoothing compound into the surface structures of the building board
- recalibrating to the nominal thickness of the building board.

Preferably, the method a further comprises a step of removing at least 10 wt.-% of the applied smoothing compound which is carried out between the steps of pressing the smoothing compound into the surface structures of the building board and the step of recalibrating to the nominal thickness of the building board.

According to a particularly preferred embodiment of the invention, the decorative building board meets the requirements of a fire resistance class B1 according to DIN EN 13501-1. For this purpose, the building board should be made from a fire-resisting material, for example in gypsum, gypsum fibre or cement.

The method is characterised in that the ready decorated building board has only an extremely thin coating of smoothing compound, colour and optionally a cover layer. Nonetheless, the optical quality is so high that an end user has no wish to apply any further colour coats. Only then it can actually be assumed that the building board also has the desired fire resistance in use. In the case of inadequately decorated or undecorated building boards, there is always the risk of the end user rectifying the decoration in that the latter for example papers walls or paints them with paints in a quantity which is such that it leads to the promised fire resistance class of the used building boards no longer being complied with.

The described method is of course also suitable for producing decorative building boards that do not meet the requirements of a fire resistance class. The method also proves to be useful in the case of combustible building boards, because it produces decorative boards with a high surface quality.

The first calibration of the building board serves for the production of as even a surface as possible and a defined height or thickness over the entire area of the building board. Both the even surface and the defined thickness of the building board are essential prerequisites for ensuring that a coating with homogeneous optical properties and a high optical quality can be produced.

A first layer of smoothing compound is first applied to the surface thus calibrated and pressed under pressure into recesses (e.g. cavities) and still remaining unevennesses. The quantity of the applied smoothing compound in this stage is so high that an optimally uniform distribution is possible. Excess smoothing compound can optionally be removed again subsequently or at the same time as the pressing-in.

According to a particularly preferred embodiment of the invention, the smoothing compound application can lie for example between 5 and 250 g/m$^2$, preferably between 80 and 150 g/m$^2$. Up to 50 wt.-% of the smoothing compound can then optionally be removed again. 10 to 35 wt.-% of the smoothing compound is preferably removed again and the smoothing compound remaining on the building board is dried.

The building board provided with a first layer of smoothing compound is then recalibrated, i.e. levelled, in particular ground, to the nominal thickness of the building board. The result of the levelling process is an essentially smooth building board surface which no longer has any larger cavities.

In order to obtain a greater evenness and freedom from defects, i.e. a higher quality, of the smoothed surface, it is possible to apply further layers of smoothing compound. A second layer of smoothing compound and then, if necessary, a third layer of smoothing compound are particularly preferably applied, wherein once again at least the steps of applying the smoothing compound and preferably removing a part of the smoothing compound are carried out. Particularly preferably, the smoothing compound is also pressed into the remaining unevennesses of the surface in this step.

Since the largest cavities and unevennesses are already filled with smoothing compound after the first smoothing compound application, less smoothing compound can be applied and pressed in for the application of the smoothing compound of the second and/or third layer of the smoothing compound than in the case of the first layer of the smoothing compound. Alternatively or in addition, it is also possible to remove again a greater quantity of the smoothing compound following the pressing-in.

The surface of the decorated building board preferably has a height difference over an entire area of the surface of the building board of at most 0.45 mm, preferably at most 0.30 mm.

In order to promote the brilliance of the colour coat subsequently to be applied, the smoothing compound is usually selected in a shade of white. Other colour shades are of course also suitable, should this be desired.

If the surface is to be designed coloured, a colour coat can be applied at least over a partial area on the last smoothed surface. For the protection of the colour coat, in particular against soiling and/or scratching, the at least one colour coat can be provided with a cover layer.

According to a particularly preferred embodiment, the smoothing compound application, the pressing-in and/or the removal of the applied smoothing compound after the pressing-in can be carried out by means of a roller.

The pressing-in and/or the removal of the smoothing compound is preferably carried out with a roller rotating in the opposite direction (to the transport direction of the building boards). Especially preferably, the pressing-in and the removal of the smoothing compound are carried out in one work step by means of the same roller.

In order to constitute the pressing-in of the smoothing compound in a particularly effective way, the spacing between the roller for the smoothing compound application and the surface of the building board to be coated should be as small as possible. It has proved to be particularly expedient if the spacing between the roller and a substrate, on which the building board to be coated is located, is adjusted less than or equal to the nominal thickness of the building board. The surface of the building board then already experiences, without a smoothing compound layer being applied, a certain pressure when it passes the roller.

A board smoothed according to the invention can for example meet the following quality criteria:

Open cavities, over which the uppermost smoothing compound layer is interrupted, do not comply with the quality criteria.

Closed cavities, in the case of which the uppermost smoothing compound layer is closed, but the surface is not smooth, but rather curved inwards, are permissible provided that they do not exceed a specific quantity per unit of surface area and/or a specific diameter ($d_L$). Building boards smoothed for example with these prerequisites can thus be produced, which take account of the following quality criteria:

not permissible:

cavities with $d_L$>2 mm permissible:

cavities with $d_L$>1 mm frequency less than 1 cavity/m$^2$ area cavities with $d_L$<1 mm frequency less than 4 cavities/m$^2$ area, or cavities with $d_L$>1 mm, frequency less than 1 cavity/m$^2$ area and cavities with $d_L$<1 mm, frequency less than 2 cavities/m$^2$ area.

In order to determine cavity diameter $d_L$ and the cavity frequency in a smoothed building board, a measurement field for example with a circle section of 1 m$^2$ area is viewed. A corresponding template is placed centrally over the largest cavity of the building board. Further defects are then looked for in the area defined by the template.

The stated quality criteria can be accordingly adapted to the coating depending on the intended use and quality requirement.

A UV-light curable smoothing compound or UV-light curable lacquer, for example based on unsaturated polyacrylates, is particularly preferably used for the smoothing compound application and/or for the at least one colour coat/or cover layer. UV-light curable smoothing compounds or lacquers have proved to be particularly expedient in industrial processing. A high drying rate can be achieved with them in a short time in a contactless manner and without great technical effort. This is of great advantage especially in the case of multiple stages which require grinding or calibration of the lacquer layer/the smoothing compound.

In principle, the most diverse methods can be used for the application of the at least one colour coat. High accuracies and colour variety can be achieved especially with digital printing processes, for which reason the latter are also mentioned here as preferred colouring processes. Further possible processes are colour application by means of roller or screen-printing.

If a digital printing process is used for the application of the at least one colour coat, it is recommendable to use a primer, which provides an absorbent substrate for the lacquer.

A physically and/or chemically resistant lacquer topcoat is preferably used as a cover layer, which is usually a clear lacquer. It is of course also possible to use coloured transparent or partially transparent lacquer topcoats in order to achieve desired optical effects.

The coating, comprising the at least one smoothing compound layer and the at least one colour coat, particularly preferably has a calorific value PCS of less than 4 $MJ/m^2$, so that the building board meets the requirements of fire resistance class B1, preferably A2-s1, d0 (see DIN EN 13501-1 in connection with prEN ISO 1716 and EN 13823).

The invention is explained below in greater detail with the aid of an example of a preferred embodiment.

According to this example of the invention, a building board is first selected, which in production should already provide surfaces with very good quality. Thus, for example, building boards which have holes or cavities with a diameter greater than one centimetre or ones which are not basically even are omitted.

The selected building board, a gypsum fibreboard, is first calibrated to a nominal thickness, wherein the surface of the building board is levelled out as far as possible. In this process carried out by way of example, the calibration is set such that the surface of the calibrated building board has a tolerance of +/−0.15 mm.

The building board thus prepared is then provided with a first layer of smoothing compound. The smoothing compound is applied with a roller application in a quantity of 80 to 130 $g/m^2$ and pressed into the surface unevennesses of the building board by means of a roller rotating in the opposite transport direction. The roller has a spacing from the conveyor belt running below in a magnitude of the nominal thickness of the building board, so that the building board is passed under pressure between the roller and the substrate.

In this example, the roller, with which the pressing-in of the smoothing compound is carried out, is at the same time the roller which removes an excess part of the smoothing compound again from the building board surface. Alternatively, an additional roller can of course also be provided for removing the excess part of the smoothing compound.

The smoothing compound used is a white UV-light curable smoothing compound. The surface is irradiated with UV-light after or, optionally, during the application and pressing-in of the smoothing compound, so that the smoothing compound is cured.

The building board is then recalibrated to the nominal thickness with the dried/cured smoothing compound layer. The surface is ground for this purpose. The result of this grinding process is a mixed and already very even and largely defect-free (i.e. cavity-free) surface. A mixed surface is understood here to mean that the surface is ground away to such an extent that the material of the building board is partially visible again. The surface of the building board thus comprises areas which are completely covered with smoothing compound and areas in which the material of the building board is at least partially visible.

The purpose of this treatment is to fill cavities or surface defects inevitably present in the building board as far as possible with smoothing compound, whereas in the other areas as little as possible, preferably even no smoothing compound is applied. This makes for use of (combustible) smoothing compound that is as sparing as possible.

Depending on the quality requirement on the smooth surface, a further layer of smoothing compound can be applied after the calibration. This layer is also again pressed into the still remaining surface unevennesses and excess smoothing compound is removed again. This dried smoothing compound layer can also optionally be ground in order to reduce the thickness. However, calibration is preferably not carried out again to the nominal thickness in this grinding step, but rather a continuous thin smoothing compound layer is left.

These process steps for the application of a further smoothing compound layer to produce a still better surface quality can optionally be repeated.

The ready smoothed surface can now be provided with a colour coat and/or a cover layer. Both the used colours and also the materials for the cover layer are preferably UV-light curable lacquers. The colour application can take place by means a digital printer, for example arranged inline, and can comprise the application of a primer layer.

The building board thus produced is a colour-decorative building board, the smoothed surface whereof meets the following quality criteria: It has no cavity with $d_L$>1 mm. The surface has 3 cavities with $d_L$<1 mm per $m^2$ area. The decorative building board meets the requirements of fire resistance class B1 according to DIN EN 13501-1.

The invention claimed is:

1. A method for the automated decoration of a building board, comprising at least one smoothing compound layer, comprising the steps of smoothing and decorating the building board, wherein the smoothing of the building board includes at least the following steps:

calibrating the building board to a nominal thickness, so that a surface of the building board has a height difference over an entire area of the surface of the building board of at most 1 mm applying a first layer of a smoothing compound on the surface of the building board pressing the smoothing compound into the surface structures of the building board recalibrating to the nominal thickness of the building board;

wherein the building board is a gypsum-bound building board, a cement-bound fibreboard, or a mineral fibreboard.

2. The method according to claim 1, wherein between the step of pressing the smoothing compound into the surface structures of the building board and the step of recalibrating to the nominal thickness of the building board a further step of removing at least 10 wt.-% of the applied smoothing compound is carried out.

3. The method according to claim 1, wherein a second layer of smoothing compound is applied, wherein once again at least the steps of applying the smoothing compound and removing a part of the smoothing compound are carried out.

4. The method according to claim 3, wherein the same amount or less smoothing compound is applied and pressed in for the application of the smoothing compound of the second layer of the smoothing compound than in the case of the first layer of the smoothing compound.

5. The method according to claim 3, wherein a third layer of smoothing compound is applied, wherein once again at least the steps of applying the smoothing compound and removing a part of the smoothing compound are carried out.

6. The method according to claim 5, wherein at least one colour coat is applied on the last smoothed surface after recalibrating, and optionally provided with a cover layer.

7. The method according to claim 6, wherein a UV-light curable smoothing compound is used for the smoothing compound application and/or at least one UV-light curable lacquer is used for the at least one colour coat/or the cover layer.

8. The method according to claim 3, wherein at least one colour coat is applied on the last smoothed surface after recalibrating, and optionally provided with a cover layer.

9. The method according to claim 8, wherein a UV-light curable smoothing compound is used for the smoothing compound application and/or at least one UV-light curable lacquer is used for the at least one colour coat/or the cover layer.

10. The method according to claim 1, wherein the pressing-in of the smoothing compound and/or the removal of the smoothing compound is carried out by means of a roller.

11. The method according to claim 10, wherein a spacing between the roller for the smoothing compound application and a substrate, on which the building board to be coated is located, is adjusted less than or equal to the nominal thickness of the building board.

12. The method according to claim 1 wherein at least one colour coat is applied on the last smoothed surface after recalibrating, and optionally provided with a cover layer.

13. The method according to claim 12, wherein a UV-light curable smoothing compound is used for the smoothing compound application and/or at least one UV-light curable lacquer is used for the at least one colour coat/or the cover layer.

14. The method according to claim 13, wherein the at least one colour coat is produced by a roller application of the light curable lacquer and/or by a digital print.

15. The method according to claim 1, wherein the gypsum-bound building board is a plasterboard or a gypsum fibreboard.

16. The method according to claim 1, wherein the decorative building board at least meets the requirements of a fire resistance class B1 according to DIN EN 13501-1.

17. The method according to claim 1, wherein the decorative building board at least meets the requirements of a fire resistance class A2 according to DIN EN 13501-1.

* * * * *